United States Patent [19]

Ohki et al.

[11] Patent Number: 4,542,086

[45] **Date of Patent: * Sep. 17, 1985**

[54] COLOR DIFFUSION TRANSFER ELEMENT WITH HYDROQUINONE TYPE COMPOUND

[75] Inventors: Nobutaka Ohki; Motohiko Tsubota; Masakazu Morigaki; Tsutomu Hamaoka, all of Kanagawa, Japan

[73] Assignee: Fuji Photo Film Co., Ltd., Kanagawa, Japan

[ * ] Notice: The portion of the term of this patent subsequent to Jan. 31, 2001 has been disclaimed.

[21] Appl. No.: 266,781

[22] Filed: May 26, 1981

[30] Foreign Application Priority Data

May 26, 1980 [JP] Japan ..... 55-69972

[51] Int. Cl.[4] ..... G03C 1/40; G03C 5/54

[52] U.S. Cl. ..... 430/218; 430/214; 430/485

[58] Field of Search ..... 430/218, 223, 214

[56] References Cited

U.S. PATENT DOCUMENTS 4,201,578 5/1980 Abbott ..... 430/218

4,429,031 1/1984 Tsubota et al. ..... 430/218

OTHER PUBLICATIONS

"Photographic Processes and Products", *Research Disclosure,* No. 15162, 11/1976, pp. 76–89.

*Primary Examiner*—Richard L. Schilling

*Attorney, Agent, or Firm*—Sughrue, Mion, Zinn, Macpeak, and Seas

[57] ABSTRACT

A color diffusion transfer photographic element comprising (a) a light sensitive component containing at least one light sensitive silver halide emulsion layer associated with a dye releasing redox compound, (b) a dye image receiving component and (c) an alkaline processing composition component, wherein the improvement comprises at least one of said components (a), (b) and (c) containing a diffusible hydroquinone type compound having the half wave potential of polarography in the range of from −300 mV to −380 mV measured using a saturated calomel electrode as a reference electrode in a buffer solution having a pH of 13.0° at 25° C. The diffusible hydroquinone type compound has excellent gradation control properties and is particularly suitable for controlling gradation of the toe part in a photographic characteristic curve of a color diffusion transfer photograph. A typical example of a diffusible hydroquinone compound of the invention is:

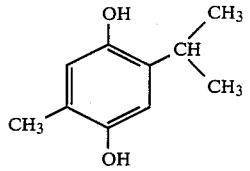

20 Claims, No Drawings

COLOR DIFFUSION TRANSFER ELEMENT WITH HYDROQUINONE TYPE COMPOUND

FIELD OF THE INVENTION

The present invention relates to a color photographic element and, particularly, to a photographic element useful for a color diffusion transfer process. More particularly, the present invention relates to a color diffusion transfer photographic element using a silver halide developing agent capable of cross-oxidizing a dye releasing redox compound.

BACKGROUND OF THE INVENTION

Hydroquinones are known to be useful in color diffusion transfer photographic elements. Examples of such compounds are described in U.S. Pat. Nos. 3,537,849, 3,253,915, 3,039,869, 3,192,044 and 3,411,904. The photographic elements described therein are color diffusion transfer photographic elements using a dye developing agent as a dye image forming material. More specifically, they are color diffusion transfer photographic elements wherein the dye image forming material in a reduced state (i.e., the dye developing agent itself) is movable in an alkaline medium, but is mordanted in the image receiving component to form a color image and an oxidized dye developing agent which are immovable. The function of these hydroquinones in such photographic elements is to assist the development of silver halide by the dye developing agent.

In addition to the above-described color diffusion transfer photographic elements used, it is known to use a dye releasing redox compound capable of releasing a diffusible dye as a result of a redox reaction with an oxidation product of the developing agent caused by development of silver halide as a dye image forming material. It has been described in *Research Disclosure,* No. 15162, page 79 (published in November, 1976) that, in such color diffusion transfer photographic elements, certain kinds of hydroquinones hinder cross-oxidation of the oxidation product of the developing agent and the dye releasing redox compound to control gradation.

In the present specification, a compound having the above-described function of controlling gradation is called a "competitive developing agent".

A further description in *Research Disclosure,* No. 15162 indicates that hydroquinone, methylhydroquinone and t-butylhydroquinone are particularly effective as competitive developing agents. The use of hydroquinone, methylhydroquinone and t-butylhydroquinone have an effect on controlling gradation. However, sufficient control of the gradation cannot be achieved utilizing these compounds.

A color diffusion transfer photographic elements comprising (a) a photosensitive component containing at least one photosensitive silver halide emulsion layer combined with a dye-releasing redox compound, (b) a dye image receiving component and (c) an alkaline processing composition component, wherein at least one of the above described components (a), (b) and (c) contains a compound represented by the following general formula

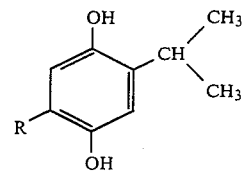

where R represents a substituted or unsubstituted alkyl group having from 1 to 18 carbon atoms, are described in U.S. Ser. No. 193,495, filed on Oct. 3, 1980 and now U.S. Pat. No. 4,429,031.

SUMMARY OF THE INVENTION

An object of the present invention is to provide color diffusion transfer photographic elements containing a competitive developing agent having excellent gradation control properties.

Another object of the present invention is to provide a process particularly useful for controlling gradation of the toe part in a photographic characteristic curve of color diffusion transfer photographs.

The above-described objects have been attained by providing color diffusion transfer photographic elements comprising: (a) a light sensitive component containing at least one light sensitive silver halide emulsion layer associated with a dye releasing redox compound; (b) a dye image receiving component; and (c) an alkaline processing composition component. At least one of the above-described components (a), (b) or (c) contains a diffusible hydroquinone type compound having a half wave potential of polarography in the range of from −300 mV to −380 mV measured using a saturated calomel electrode as a reference electrode in a buffer solution having a pH of 13.0 at 20° C.

DETAILED DESCRIPTION OF THE INVENTION

Useful diffusible hydroquinone type compounds having the potential of the above-described range according to the present invention include compounds which provide a favorable effect of controlling gradation. These useful compounds are selected from compounds represented by the following general formula (I):

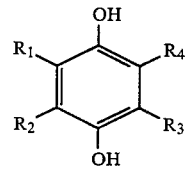

wherein $R_1$, $R_2$, $R_3$ and $R_4$ each independently represent hydrogen, a halogen atom (for example, a chlorine atom, a bromine atom, etc.), a substituted or unsubstituted alkyl group (which may be a straight chain or a branched chain group having 1 to 10 carbon atoms in the total, for example, a methyl group, an ethyl group, an n-propyl group, an isobutyl group, a secbutyl group, a tert-hexyl group, etc.), an alkoxy group (which may be a straight chain or a branched chain and which have 1 to 10 carbon atoms in the total, for example, a methoxy group, an n-butoxy group, a tert-butoxy group, etc.), an alkylthio group (having 1 to 10 carbon atoms in the total, for example, a methylthio group, a tert-butylthio group, a hexylthio group, etc.), an alkenyl group (having 1 to 10 carbon atoms in the total, for example, a vinyl group, an allyl group, an octenyl group, etc.), a cycloalkyl group (having 5 to 7 carbon atoms in the total, for example, a cyclohexyl group, a 1-methylcyclohexyl group, etc.), a cycloalkoxy group (having 5 to 7 carbon atoms in the total, for example, a cyclohexyloxy group, etc.), an aryl group (which may be a monocyclic group having 6 to 10 carbon atoms in the total, for example, a phenyl group, a p-methylphenyl group, a p-methoxyphenyl group, etc.), an acylamino group (having 2 to 10 carbon atoms in the total, for example, an acetylamino group, a propanoylamino group, a butanoylamino group, etc.), a diacylamino group (having 4 to 10 carbon atoms in the total, for example, a diacetylamino group, an acetyl benzoylamino group, etc.), an acyloxy group (having 2 to 10 carbon atoms in the total, for example, an acetyloxy group, a butanoyloxy group, a benzoyloxy group, etc.), a sulfonamido group (having 1 to 10 carbon atoms in the total, for example, a methylsulfonamido group, an acylsulfonamido group, a phenylsulfonamido group, etc.), an alkylamino group (having 1 to 10 carbon atoms in the total, for example, a methylamino group, a butylamino group, etc.).

The substituents referred to above may be freely selected from conventional substituents. However, examples of prepared substituents include a halogen atom (for example, a chlorine atom, a bromine atom, etc.), a nitro group, a cyano group, a hydroxy group, a carboxy group, an amino group, a sulfo group, an aryl group (for example, a phenyl group, etc.), an alkoxy group (for example, a methoxy group, an ethoxy group, etc.). These are preferred as the substituent for the alkyl group, the alkoxy group, the alkylthio group or the alkenyl group represented by $R_1$ to $R_4$.

In the general formula (I) described above, $R_1$, $R_2$, $R_3$ and $R_4$ may be the same or different from each other and the total number of the carbon atoms present in $R_1$, $R_2$, $R_3$ and $R_4$ is 12 or less.

In the following, specific examples of the diffusible hydroquinone type compounds preferably used in the present invention are set forth, but the present invention is not to be construed as being limited to these.

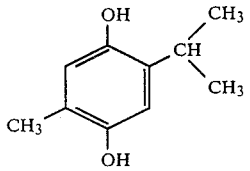

Compound (1)

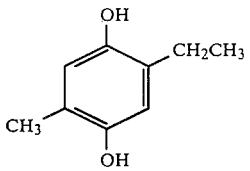

Compound (2)

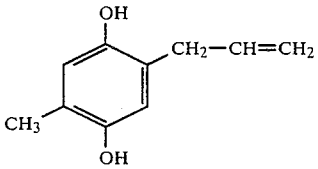

Compound (3)

-continued

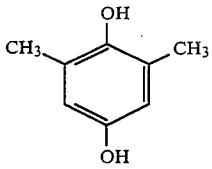

Compound (4)

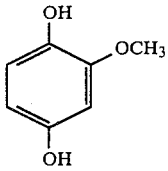

Compound (5)

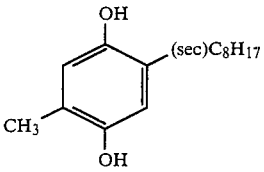

Compound (6)

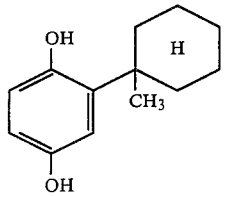

Compound (7)

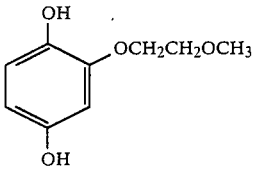

Compound (8)

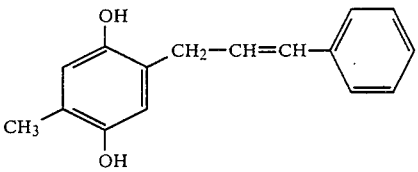

Compound (9)

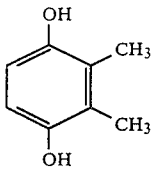

Compound (10)

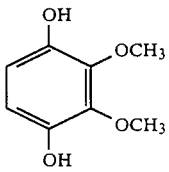

Compound (11)

-continued

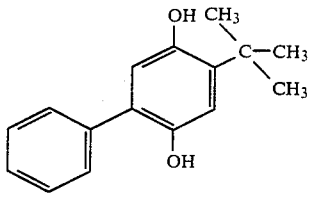

Compound (12)

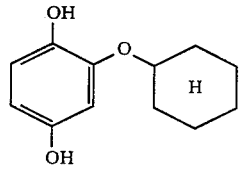

Compound (13)

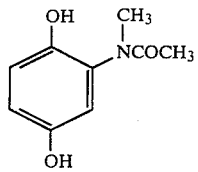

Compound (14)

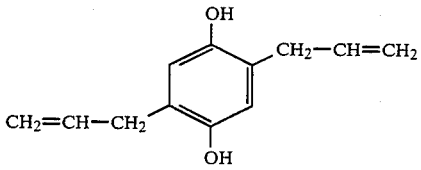

Compound (15)

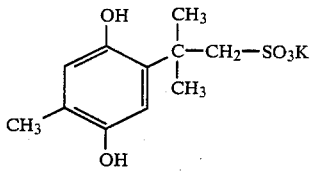

Compound (16)

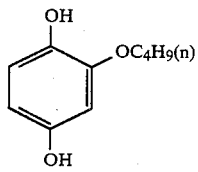

Compound (17)

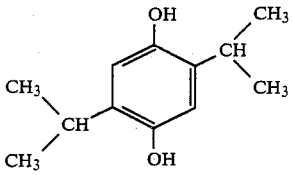

Compound (18)

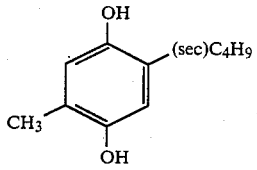

Compound (19)

-continued

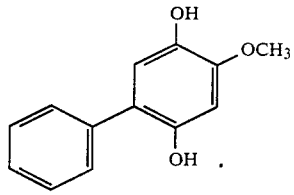

Compound (20)

The compounds represented by the general formula (I) used in the present invention are known substances to be useful as developing agents and antioxidants, which have been described, for example, in *Organic Syntheses Collective,* Vol. 1, page 511 (1961), *Journal of the American Chemical Society* (*J.A.C.S.*), Vol. 82, page 1928 (1960), Japanese Patent publication No. 4614/64, Japanese Patent Application (OPI) No. 98933/78, West German Patent Application (OLS) No. 2,724,488, etc. Compounds useful in the present invention which are not specifically described in the foregoing literature can be synthesized with according to the processes described by appropriate selection of starting materials that would be clear to those skilled in the art.

The above-described compounds used as competitive developing agents of the present invention have an excellent gradation controlling function as compared with the known hydroquinone, methylhydroquinone, and t-butylhydroquinone compounds, by which the toe part of the characteristic curve becomes high contrast. When utilizing the compounds of this invention, improvement in color reproduction is observed due to the improvement of gradation of the toe part.

The above-described hydroquinones such as hydroquinone, methylhydroquinone and t-butylhydroquinone cause severe reduction of the transfer image density ($D_{max}$) when it is intended to substantially control the gradation of the toe part. However, the compounds of the present invention produce a desired gradation with less reduction of the transfer image density.

It is surprising that a preferred effect of controlling gradation can be obtained by use of the compounds of the present invention, because the effect could not be obtained when known hydroquinones such as 2,5-dibromohydroquinone, 2,5-dimethoxyhydroquinone, 2,5-di-tert-butylhydroquinone, 2,3,5-trimethylhydroquinone, etc. were used.

These results can be explained as follows. A color diffusion transfer photographic element may use, as a dye image forming material, a dye releasing redox compound capable of releasing a diffusible dye. The release of diffusible dye occurs as a result of a redox reaction with an oxidation product of the developing agent caused by development of silver halide. The structure of the developing agent and the dye releasing redox compound each of which has a redox potential in an appropriate range are determined by considering conditions such as the redox reactivity, the stability before development, etc. based on the reduction potential at the development of silver halide, as described below in greater detail. It is believed that the gradation controlling effect of a competitive developing agent is produced by hindering the cross oxidation of the oxidation product of the developing agent and the dye releasing redox compound. That is, it is believed that there is a pertinent range in the redox potential suitable for an effective competitive developing agent.

As a result of various investigations, we have found that the diffusible hydroquinone type compounds having a half wave potential of polarography in the range of from −300 mV to −380 mV provide desirable results. The measurement being made using a saturated calomel electrode as a reference electrode in a Britton-Robinson universal buffer solution having a pH of 13.0 at 25° C. These compounds provide a preferred effect on controlling gradation as competitive developing agents. Table A below shows the hydroquinone type compounds having an extremely large effect on controlling gradation. representatively set forth the Specific compounds (described above) according to the present invention, have a potential within the above-described range. However, the potential of the compounds which have a weak gradation controlling function (for example, the known competitive developing agent such as hydroquinone, methylhydroquinone and t-butylhydroquinone) have gradation controlling functions outside of the above described range.

Of the diffusible hydroquinone type compounds having the potential within the above described range, the compounds which have the half wave potential of polarography in the range of from −310 mV to −350 mV have a particularly preferred effect on controlling gradation.

TABLE A

| Compound | E ½ vs S.C.E. at pH 13.0 (mV) |
|---|---|
| Hydroquinone (Comparison) | −200 |
| 2-Methylhydroquinone (Comparison) | −275 |
| 2-t-Butylhydroquinone (Comparison) | −295 |
| (1) | −340 |
| (2) | −330 |
| (3) | −310 |
| (4) | −325 |
| (5) | −315 |
| (6) | −355 |
| (7) | −305 |
| (8) | −320 |
| (9) | −315 |
| (10) | −330 |
| (11) | −305 |
| (12) | −320 |
| (13) | −330 |
| (14) | −335 |
| (15) | −310 |
| (16) | −360 |
| (17) | −320 |
| (18) | −345 |
| (19) | −340 |
| (20) | −340 |
| 2,5-Dibromohydroquinone (Comparison) | −180 |
| 2,5-Dimethoxyhydroquinone (Comparison) | −450 |
| 2,5-Di-t-butylhydroquinone (comparison) | −390 |
| 2,3,5-Trimethylhydroquinone (Comparison) | −460 |

The half wave potential of polarography shown in Table A above was measured in a britton-Robinson universal buffer solution having a pH of 13.0. The method for preparation of the buffer solution was as follows. 2.71 ml of a 85% orthophosphoric acid, 2.36 ml of a 96% glacial acetic acid and 2.47 g of boric acid were dissolved in water and diluted to make the total volume 1000 ml which was designated Solution A. 8.00 g of sodium hydroxide was dissolved in water and diluted to make the total volume 1000 ml which was designated Solution B. These solutions were mixed in a ratio of 310 ml of Solution B per 100 ml of solution A to obtain the derived buffer solution.

The data of half wave potential shown in Table A above were also measured by a voltammetric analyzer Model P-1000 (manufactured by Yanagimoto Seisakusho Co., Ltd.) using a dropping mercury electrode and a saturated calomel electrode as a reference electrode. The concentration of the samples measured was $10^{-3}$ mol/liter to $10^{-4}$ mol/liter.

In the present invention, the diffusible hydroquinone type compound having the half wave potential within the above described range can be incorporated into at least one of the above-described components (a), (b) and (c). However, a preferable embodiment of the present invention is color diffusion transfer photographic elements in which the diffusible hydroquinone type compound is incorporated into the alkaline processing composition component (c).

In a preferred embodiment, the compound having the half wave potential within the above-described range and represented by the general formula (I) is incorporated into the alkaline processing composition component.

In a more preferred embodiment, the compound having the half wave potential within the above described range and represented by the general formula (I) wherein two of $R_1$, $R_2$, $R_3$ and $R_4$ each represents hydrogen and other two of $R_1$, $R_2$, $R_3$ and $R_4$ each represents a substituted or unsubstituted alkyl group or a substituted or unsubstituted alkenyl group (these two groups may be the same or different each other and the total number of the carbon atoms included in these two groups is 12 or less) is incorporated into the color diffusion transfer photographic element particularly, into the alkaline processing composition component.

In another more preferred embodiment, the compound having the half wave potential within the above-described range and represented by the general formula (I) wherein $R_1$, $R_2$ and $R_3$ each represents hydrogen and $R_4$ represents a substituted or unsubstituted alkoxy group is incorporated into the color diffusion transfer photographic element particularly, into the alkaline processing composition component.

A preferred amount of the above-described diffusible hydroquinone type compound in the alkaline processing composition component is from about 0.05 to about 1 g per Kg of the processing composition. The amounts hardly vary depending upon the placement in above-described components (a), (b) and (c), or depending on a kind of the compounds represented by the general formula (I).

The processing composition composing the processing composition component used in the present invention is a liquid composition containing processing components necessary to develop silver halide emulsions and to form diffusion transfer images, or dye images which remain after released dyes have diffused. The solvent of such a processing composition is composed mainly of water and may contain hydrophilic solvents such as methanol or 2-methoxyethanol. The processing composition contains alkali in an amount sufficient to maintain a pH required for development of the emulsion layes and to neutralize acids formed during steps of development and dye image formation (for example, hydrohalogenic acids such as hydrobromic acid).

Useful silver halide developing agent contained in the processing composition include any silver halide developing agent provided that it causes cross-oxidation with dye releasing redox compounds. This developing agent can be added to the light sensitive element, if desired, because it is only activated by the alkali processing composition when development of silver halide begins substantially.

Examples of such developing agents include 3-pyrazolidinones, for example, 1-phenyl-3-pyrazolidinone, 4,4-dimethyl-1-phenyl-3-pyrazolidinone, 4-hydroxymethyl-4-methyl-1-phenyl-3-pyrazolidinone, 4-hydroxymethyl-4-methyl-1-tolyl-3-pyrazolidinone, 4-hydroxymethyl-4-methyl-1-(4'-methoxy)-3-pyrazolidinone, 4,4-bis(hydroxymethyl)-1-phenyl-3-pyrazolidinone, 4,4-bis(hydroxymethyl)-1-tolyl-3-pyrazolidinone, 4,4-bis(hydroxymethyl)-1-(4'-methoxy)-3-pyrazolidinone, 4,4-dimethyl-1-tolyl-3-pyrazolidinone and 1,5-diphenyl-3-pyrazolidinone; aminophenols, for example, p-aminophenol, p-methylaminophenol, p-dimethylaminophenol, p-dibutylaminophenol, p-piperidinophenol, and 4-dimethylamino-2,6-dimethoxyphenol; phenylenediamines, for example, N-methyl-p-phenylenediamine, N-ethyl-p-phenylenediamine, N,N-dimethyl-p-phenylenediamine, N,N-diethyl-p-phenylenediamine, N,N,N',N'-tetramethyl-p-phenylenediamine and 4-diethylamino-2,6-dimethoxyaniline; and reductones, for example, piperidinohexose reductone and pyrrolidinohexose reductone. Among above-described developing agents, 3-pyrazolidinones are preferred.

Useful alkali donative substances in the alkali processing composition typically include alkali metal hydroxides (for example, sodium hydroxide, potassium hydroxide, rubidium hydroxide and cesium hydroxide. Other useful alkali donative substances include sodium carbonate and amines such as diethylamine. The alkaline processing composition preferably has a pH of 11 or more due to these alkali donative substances.

It is preferred that the alkaline processing composition used in the present invention contain viscosity increasing compounds. Examples of such viscosity increasing compounds include ethers inactive to alkaline solutions, such as alkali metal salts of hydroxyethyl cellulose or carboxymethyl cellulose (for example, sodium carboxymethyl cellulose). An advantageous amount of these is from 1 to 10% by weight of the processing composition. The viscosity is preferably from about 100 to 200,000 cps. Accordingly, in addition to the above-described viscosity increasing compounds, it is possible to use polysaccharide gums such as guar gums, xanthans and Algins as described in *Research Disclosure,* No. 15162 (November, 1976) as the viscosity increasing compounds.

The alkaline processing compositions used in the present invention preferably contain light-shielding agents. Examples of such agents include carbon black, titanium dioxide, and light-absorbind dyes, for example, indicator dyes. The indicator dyes are preferably those which are transparent when exposed to light, but which develop color or become opaque when brought into contact with alkali from the processing composition.

Further, the photographic elements of the present invention may contain various other known compounds for particular purposes. However, it is preferable to add such compounds to the alkaline processing composition.

The photographic elements of the present invention may contain additives which increase transfer image densities. For example, aromatic alcohols such as benzyl alcohol and p-xylene-$\alpha,\alpha'$-diols as described in U.S. Pat. No. 3,846,129, can be used for this purpose. Examples of other useful additives include aliphatic or alicyclic glycols and saturated aliphatic or alicyclic aminoalcohols as described in U.S. Pat. No. 4,030,920, for example, 1,4-cyclohexanedimethanol, 1,6-hexanediol, 3-amino-1-propanol, 2-amino-1-propanol, 5-amino-1-pentanol, 6-amino-1-hexanol and 2-amino-2-methyl-1-propanol.

Other compounds for increasing $D_{max}$ include colloidal silica and potassium iodide described in *Research Disclosure,* No. 15162 (November, 1976):

The photographic elements of the present invention may contain compounds described in U.S. Pat. No. 3,942,987, which prevent the occurrence of pimple-like deformations after development has substantially concluded. Examples of these compounds include alkali metal fluorides and oxalates and barium salts.

It is possible to control gradation by using a combination of competitive developing agents described in *Research Disclosure,* 15162 (November, 1976). Examples of such agents include hydroquinone, methylhydroquinone and t-butylhydroquinone.

The photographic elements of the present invention may contain compounds as described in U.S. Pat. No. 2,497,917, such as, for example, 5-methylbenzotriazole, 5,6-dichlorobenzotriazole, 6-nitrobenzimidazole, histidine.

The alkaline processing composition used in the present invention generally includes pigments such as carbon black or titanium dioxide dispersed uniformly therein. Known dispersion assistants and surface active agents can be used with the pigments. Examples of useful surface active agents include alkali metal salts of polyacrylic acid, naphthalenesulfonic acid, polycondensate of naphthalenesulfonic acid and formaldehyde, and polystyrenesulfonic acid.

The dye releasing redox compounds used in the present invention can be represented by the following formula (II)

$$Y—D \qquad \text{(II)}$$

wherein Y represents a component which provides a dye compound having a diffusibility different from that of the dye releasing redox compound represented by the formula (II) as a result of development processing under an alkaline condition. Generally, Y has a "ballast group" for rendering the dye releasing redox compound nondiffusible. D may be a dye itself or may be the dye and a group for linking the dye to Y. Typical examples of such dyes include azo dyes. An effective example of Y is an N-substituted sulfamoyl group. Examples of Y include groups represented by the formula (A).

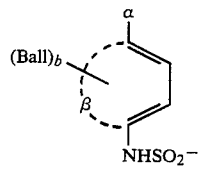

(A)

In the formula (A), represents a non-metal atomic group necessary to form a benzene ring which may condense with a carbocyclic or heterocyclic ring, such as a naphthalene ring, a quinoline ring, a 5,6,7,8-tetrahydronaphthalene ring or a coumarone ring. Further, the above-described benzene ring or ring formed by condensation of the benzene ring with the carbon ring or the hetero ring may be substituted by halogen atoms, alkyl groups, alkoxy groups, aryl groups, aryloxy groups, nitro groups, amino groups, alkylamino groups, arylamino groups, amido groups, cyano groups, alkylmercapto groups, keto groups, carboalkoxy groups or heterocyclic groups.

$\alpha$ represents a group represented by $-OG^1$ or $-NHG^2$, wherein $G^1$ represents hydrogen or a group which forms hydroxyl group by hydrolysis, and, preferably, it represents hydrogen or a group represented by $$-\overset{O}{\overset{\|}{C}}G^3 \text{ or } -\overset{O}{\overset{\|}{C}}-O-G^3$$

wherein $G^3$ represents an alkyl group, particularly, an alkyl group having from 1 to 18 carbon atoms such as a methyl group, an ethyl group, or a propyl group, a halogen-substituted alkyl groups having from 1 to 18 carbon atoms such as a chloromethyl group or a trifluoromethyl group, a phenyl group or a substituted phenyl group. Further, $G^2$ represents hydrogen, an alkyl group having from 1 to 22 carbon atoms or a group capable of hydrolyzing. A preferred group capable of hydrolyzing represented by $G^2$ is the group represented by $$-\overset{O}{\overset{\|}{C}}G^4, -SO_2G^5$$

or $-SOG^5$, wherein $G^4$ represents an alkyl group having from 1 to 4 carbon atoms such as a methyl group, a halogen-substituted alkyl group such as a mono-, di- or trichloromethyl group or a trifluoromethyl group, an alkylcarbonyl group such as an acetyl group, an alkyloxy group, a substituted phenyl group such as a nitrophenyl group or a cyanophenyl group, a phenyloxy group unsubstituted or substituted with lower alkyl groups or halogen atoms, a carboxyl group, an alkyloxycarbonyl group, an aryloxycarbonyl group, an alkylsulfonylethoxy group or an arylsulfonylethoxy group, and $G^5$ represents a substituted or unsubstituted alkyl group or aryl group.

Further, b is 0 or an integer of 1 or 2. But except the case that $\alpha$ contains, as $G^2$ in $-NHG^2$, a group corresponding to the alkyl group which makes the compound represented by the above-described formula (A) immovable and non-diffusible, namely, when $\alpha$ is the group represented by $-OG^1$ or the group $-NHG^2$ wherein $G^2$ represents hydrogen, an alkyl group having from 1 to 8 carbon atoms or a group capable of hydrolyzing, b is 1 or 2 and preferably 1. Ball represents a ballast group. Such ballast group is illustrated in detail in the following.

Examples of this kind of Y and dye releasing redox compounds have been described in U.S. Pat. Nos. 3,928,312, 3,993,638, 4,076,529, and 4,152,153, Japanese Patent Application (OPI) No. 50736/78. Another example of Y suitable for such compounds includes the group represented by the following formula (B)

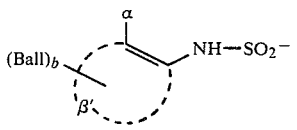

(B)

In the formula (B), Ball, $\alpha$, and b each has the same meaning as in the case of the formula (A), and $\beta'$ represents an atomic group necessary to form a carbocyclic ring such as a benzene ring which may condense with a carbocyclic or heterocyclic ring to form a naphthalene ring, a quinoline ring, a 5,6,7,8-tetrahydronaphthalene ring or a coumarone ring. Further, the above-described rings may be substituted with halogen atoms, alkyl groups, alkoxy groups, aryl groups, aryloxy groups, nitro groups, amino groups, alkylamino groups, arylamino groups, amido groups, cyano groups, alkylmercapto groups, keto groups, carboalkoxy groups or heterocyclic groups. Examples of this kind of Y and dye releasing redox compounds have been described in Japanese Patent Application No. 91187/79, Japanese Patent Application (OPI) No. 113624/76 and U.S. Pat. No. 4,053,312. A further example of Y suitable for this type of compound includes the group represented by the following formula (C)

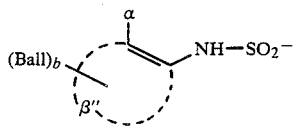

(C)

In the formula (C), Ball, $\alpha$, and b each has the same meaning as in the case of the formula (A) and $\beta''$ represents an atomic group necessary to form a heterocyclic ring such as a pyrazole ring or a pyridine ring, which may condense with a carbocyclic ring or a heterocyclic ring. Further, these rings may be substituted by the same kinds of substituents as those described in the formula (B). Examples of this kind of Y and dye releasing redox compounds have been described in U.S. Pat. No. 4,198,235.

A further example of Y effective for this type of compound includes the group represented by the formula (D)

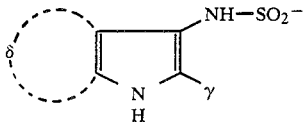

(D)

In the formula (D), $\gamma$ is preferably hydrogen, an alkyl, aryl or heterocyclic group which has substituents or is not substituted, or $-CO-G^6$ wherein $G^6$ represents $-OG^7$, $-S-G^7$ or

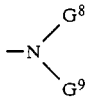

(wherein $G^7$ represents hydrogen, an alkyl group, a cycloalkyl group or an aryl group, wherein the alkyl group, the cycloalkyl group and the aryl group may have substituents, $G^8$ represents the same groups as $G^7$, or $G^8$ represents an acyl group derived from aliphatic or aromatic carboxylic acid or sulfonic acid, and $G^9$ represents hydrogen or an unsubstituted or substituted alkyl group), $\delta$ represents a residue necessary to complete a condensed benzene ring which may have one or more substituents, and the substituents on the condensed benzene ring in $\gamma$ and/or $\delta$ are ballast groups or groups containing a ballast group. Examples of this kind of Y and dye releasing redox compounds have been described in U.S. Pat. Nos. 4,198,235 and 4,179,291, and Japanese Patent Application (OPI) No. 46730/78.

Other suitable examples of Y for this type of compound include the group represented by the formula (E)

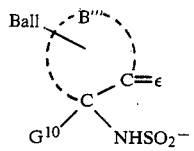

(E)

In the formula (E), Ball has the same meaning as the case of the formula (A), $\epsilon$ represents an oxygen atom or the group =NG'' (G'' represents a hydroxyl group or an amino group which may have substituents). Particularly, in the case where $\epsilon$ is the group =NG'', a typical example of G'' is that in the group =C=N—G'' formed by a dehydration reaction of a carbonyl reagent represented by $H_2N$—G'' with a ketone group. As the compound $H_2N$—G'' in this case, there are, for example, hydroxylamine, hydrazines, semicarbazides and thiosemicarbazides. Examples of hydrazines include hydrazine, phenylhydrazine, substituted phenylhydrazines having substituents such as alkyl groups, alkoxy groups, carboalkoxy groups or halogen atoms, and isonicotinic acid hydrazide. Examples of the semicarbazides include phenyl semicarbazide and substituted phenyl carbazides having substituents such as alkyl groups, alkoxy groups, carboalkoxy groups or halogen atoms. Examples of semithiocarbazides include various derivatives similar to those of semicarbazides.

Further, $\beta'''$ in the formula represents a 5-member, 6-member or 7-member saturated or unsaturated nonaromatic hydrocarbon ring. Typical examples of the ring include cyclopentanone, cyclohexanone, cyclohexenone, cyclopentenone, cycloheptanone and cycloheptenone.

Furthermore, the 5-, 6- or 7-member nonaromatic hydrocarbon ring may form a condensed ring by condensing with another ring in suitable positions thereof. Other rings may be aromatic or not aromatic which may be any hydrocarbon ring or heterocyclic ring. When forming a condensed ring, it is more preferred in the present invention that the condensed ring is formed by condensation of benzene with the above-described 5-, 6- or 7-member nonaromatic hydrocarbon ring, such as indanone, benzocyclohexenone or benzocycloheptenone.

The above-described 5-, 6- or 7-member nonaromatic hydrocarbon ring and the above-described condensed rings may have one or more substituents such as alkyl groups, aryl groups, alkyloxy groups, aryloxy groups, alkylcarbonyl groups, arylcarbonyl groups, alkylsulfonyl groups, arylsulfonyl groups, halogen atoms, a nitro group, an amino group, alkylamino groups, arylamino groups, amido groups, alkylamido groups, arylamido groups, a cyano group, alkylmercapto groups and alkyloxycarbonyl groups. $G^{10}$ represents hydrogen or a halogen atom such as fluorine, chlorine or bromine. Examples of this kind of Y and dye releasing redox compounds have been described in U.S. Pat. No. 4,149,892.

Other examples of Y in the dye releasing redox compounds have been described in U.S. Pat. Nos. 3,443,943, 3,751,406, 3,443,939, 3,443,940, 3,628,952 and 3,844,785.

Other kinds of compounds represented by the formula (II) are nondiffusible image-forming compounds which release a diffusible dye by self-ring closure under an alkaline condition but do not substantially release the dye when reacted with a developing agent oxidized product.

An example of Y effective for this kind of compound includes the group represented by the formula (F)

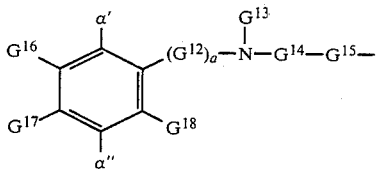

(F)

In the formula (F), $\alpha'$ is a nucleophilic group capable of oxidizing, such as a hydroxyl group, a primary or secondary amino group, a hydroxyamino group or a sulfonamido group, or a precursor thereof, and the hydroxyl group is preferred.

$\alpha''$ is a dialkylamino group or a group defined in $\alpha'$, and the hydroxyl group is preferred. $G^{14}$ represents an electrophilic group such as —CO— or —CS—, and —CO— is preferred. $G^{15}$ represents an oxygen atom, a sulfur atom, a selenium atom or a nitrogen atom which may be substituted by hydrogen, an alkyl or substituted alkyl group having from 1 to 10 carbon atoms or an aromatic residue having from 6 to 20 carbon atoms. A preferred $G^{15}$ is an oxygen atom. $G^{12}$ represents an alkylene group having from 1 to 3 carbon atoms. a is 0 or 1, preferably 0. $G^{13}$ represents a substituted or unsubstituted alkyl group having from 1 to 40 carbon atoms or a substituted or unsubstituted aryl group having from 6 to 40 carbon atoms, preferably an alkyl group. $G^{16}$, $G^{17}$ and $G^{18}$ represent each hydrogen, a halogen atom, a carbonyl group, a sulfamoyl group, a sulfonamido group, an alkyloxy group having from 1 to 40 carbon atoms or the same group as $G^{13}$, wherein $G^{16}$ and $G^{17}$ may form a 5-, 6-, or 7-member ring with each other. Further, $G^{17}$ may

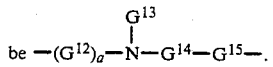

be $-(G^{12})_a-\overset{\overset{\displaystyle G^{13}}{|}}{N}-G^{14}-G^{15}-$.

At least one of $G^{13}$, $G^{16}$, $G^{17}$ and $G^{18}$ should represent a ballast group. Examples of this kind of Y and dye releasing redox compounds are described in U.S. Pat. No. 3,980,479.

A further example of Y suitable for this kind of compound includes the group represented by the formula (G)

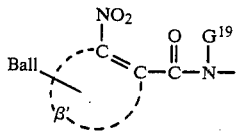

(G)

In the formula (G), Ball and $\beta'$ each has the same meaning as in the formula (B), and $G^{19}$ represents an alkyl group (including a substituted alkyl group).

Examples of this kind of Y and dye releasing redox compound have been described in U.S. Pat. No. 4,142,891.

A further example of Y suitable for this kind of compound includes the group represented by the formula (H)

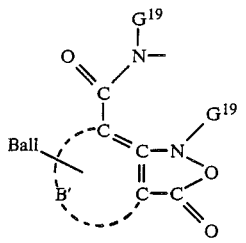

(H)

In the formula (H), Ball and $\beta'$ each has the same meaning as in the formula (B) and $G^{19}$ represents the same as that of the formula (G). Examples of this kind of Y and dye releasing redox compounds have been described in U.S. Pat. Nos. 4,199,354 and 4,199,355.

The ballast group is an organic ballast group capable of making the dye releasing redox compound nondiffusible during development in an alkaline processing solution. The ballast group preferably contains a hydrophobic group having from 8 to 32 carbon atoms. The organic ballast group links to the dye releasing redox compound directly or through a linking group (for example, an imino bond, an ether bond, a thioether bond, a carbonamido bond, a sulfonamido bond, a ureido bond, an ester bond, an imido bond, a carbamoyl bond, a sulfamoyl bond and combinations thereof).

Examples of the ballast group include alkyl groups and alkenyl groups (for example, a dodecyl group and an octadecyl group), alkoxyalkyl groups (for example, a 3-(octyloxy)propyl group and a 3-(2-ethylundecyloxy)-propyl group as described in Japanese Patent Publication No. 27563/64), alkylaryl groups (for example, a 4-nonylphenyl group and a 2,4-di-tert-butylphenyl group), alkylaryloxyalkyl groups (for example, a 2,4-di-tert-pentylphenoxymethyl group, an α-(2,4-di-tert-pentylphenoxy)propyl group and a 1-(3-pentadecylphenoxy)ethyl group), acylamidoalkyl groups (for example, groups described in U.S. Pat. Nos. 3,337,344 and 3,418,129, and a 2-(N-butylhexadecanamido)ethyl group), alkoxyaryl and aryloxyaryl groups (for example, a 4-(n-octadecyloxy)phenyl group and a 4-(4-n-dodecylphenyloxy)-phenyl group, etc.), residues having a long chain alkyl or alkenyl group and a water solubilizing group such as a carboxyl or sulfo group (for example, a 1-carboxymethyl-2-nonadecenyl group and a 1-sulfoheptadecyl group, etc.), alkyl groups substituted by an ester group (for example, a 1-ethoxycarbonylheptadecyl group and a 2-(n-dodecyloxycarbonyl)ethyl group, etc.), alkyl groups substituted by an aryl group or a heterocyclic group (for example, a 2-[4-(3-methoxycarbonylheneicosanamido)phenyl]ether group and a 2-[4-(2-n-octadecylsuccinimido)phenyl]ethyl group, etc.) and aryl groups substituted by an aryloxyalkoxycarbonyl group (for example, a 4-[2-(2,4-di-tert-pentylphenyloxy)-2-methylpropyloxycarbonyl]phenyl group, etc.).

Of the above-described organic ballast groups, those which are bonded to bridging groups as represented in the following general formulae are particularly preferred.

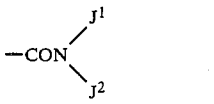

(Ball-I)

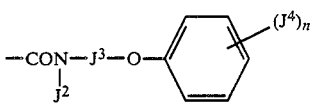

(Ball-II)

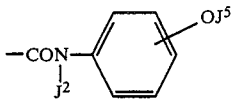

(Ball-III)

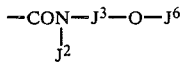

(Ball-IV)

(Ball-V)

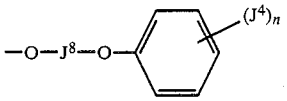

(Ball-VI)

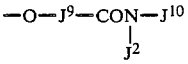

(Ball-VII)

Therein, $J^1$ represents a straight chain or branched chain alkyl group having 7 to 39 carbon atoms and preferably, having 7 to 32 carbon atoms (for example, a dodecyl group, a tetradecyl group, a hexadecyl group, etc.); $J^2$ represents hydrogen or a straight or branched chain alkyl group having 1 to 39 carbon atoms and preferably 1 to 32 carbon atoms; $J^3$ represents a straight chain or branched chain alkylene group having 1 to 10 carbon atoms and preferably, 1 to 6 carbon atoms (for example, a propylene group, a butylene group, etc.); $J^4$ represents hydrogen or a straight chain or branched chain alkyl group having 1 to 32 carbon atoms and preferably 1 to 25 carbon atoms (for example, a tert-amyl group, a pentadecyl group, etc.); $J^5$ represents a straight chain or branched chain alkyl group having 1 to 33 carbon atoms and preferably 1 to 25 carbon atoms or a group

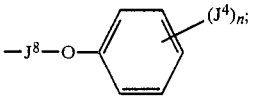

$J^6$ represents a straight chain or branched chain alkyl group having 1 to 37 carbon atoms and preferably 1 to 25 carbon atoms; $J^7$ represents an alkyl group having 8 to 40 carbon atoms and preferably 8 to 32 carbon atoms; $J^8$ represents a straight chain or branched chain alkylene group having 1 to 10 carbon atoms and preferably 1 to 6 carbon atoms; $J^9$ represents a straight chain or branched chain alkylene group having 1 to 38 carbon atoms and preferably 1 to 30 carbon atoms; $J^{10}$ represents an alkyl group having 1 to 38 carbon atoms and preferably 1 to 30 carbon atoms or a group

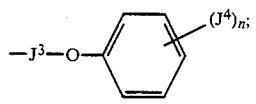

and n represents an integer of 1 to 5 (preferably 1 or 2).

In addition to the dye releasing redox compounds, patent specifications referred to above, useful compounds include 1-hydroxy-2-tetramethylenesulfamoyl-4-[3'-methyl-4'-(2''-hydroxy-4''-methyl-5''-hexadecyloxyphenylsulfamoyl)-phenylazo9 naphthalene as a magenta dye image forming substance, and 1-phenyl-3-cyano-4-{3'-[2''-hydroxy-4''-methyl-5''-(2''',4'''-di-t-pentylphenoxyacetamino)phenylfulfamoyl]phenylazo}-5-pyrazolone as a yellow dye image forming substance.

The dye releasing redox compound used in the present invention can be dispersed in a hydrophilic colloid as a carrier by various methods depending on the type of the compound. For example, the compound having a dissociative group such as a sulfo group or a carboxy group can be dispersed in a hydrophilic colloid solution as a solution in water or an alkaline aqueous solution. A compound sparingly soluble in an aqueous medium but easily soluble in an organic solvent, can be dispersed by the following manner:

(1) The compound is dissolved in a substantially water-insoluble high-boiling solvent and then the solution formed is dispersed in a hydrophilic colloid solution. Such a method is described in, for example, U.S. Pat. Nos. 2,322,027, 2,533,514 and 2,801,171. Also, if necessary, a low-boiling solvent or an organic solvent readily soluble in water may be used in the aforesaid method and such a solvent is removed by volatilization under drying or by washing with water.

(2) The compound is dissolved in a water-miscible solvent and then the solution is dispersed in a hydrophilic colloid solution.

(3) In the method (1) described above, an oleophilic polymer is used instead of the high-boiling solvent or together with the high-boiling solvent. Such a method is described in, for example, U.S. Pat. No. 3,619,195 and German Pat. No. 1,957,467.

(4) The compound is dissolved in a water-miscible solvent and to the solution is gradually added an aqueous latex to provide a dispersion wherein the compound is incorporated in the latex particles. This method is described in, for example, Japanese Patent Application (OPI) No. 59943/76.

Moreover, a hydrosol of an oleophilic polymer described, for example, in Japanese Patent Publication No. 39835/76 may be added to the hydrophilic colloid dispersion obtained by the above-described method.

The dispersion of the dye releasing redox compound is greatly promoted by using a surface active agent as an emulsifying aid. Examples of the useful surface active agents are described in the above mentioned patent specifications and Japanese Patent Publication No. 4923/64 and U.S. Pat. No. 3,676,141.

Examples of the hydrophilic colloids useful for dispersing the dye releasing redox compound used in the present invention include, for example, gelatin, colloidal albumin, casein, a cellulose derivative such as carboxymethyl cellulose, hydroxyethyl cellulose, etc., a succaride derivative such as agar-agar, sodium alginate, a starch derivative, etc., and a synthetic hydrophilic colloid such as polyvinyl alcohol, poly-N-vinyl pyrrolidone, polyacrylic acid copolymer, polyacrylamide, and a derivative thereof (for example, a partially hydrolyzed product). If necessary, these colloids may be used as a miscible mixture containing two or more thereof. Among the aforesaid materials, gelatin is most generally used and gelatin may be partially or wholly replaced with a synthetic hydrophilic colloid.

The dye releasing redox compound used in the present invention can be used in such an amount that a molar ratio of silver of the silver halide emulsion associated therewith to the dye releasing redox compound is in the range of from about 50 to 0.5 and preferably from about 10 to 2.

The coating amount of the dye releasing redox compound is from $1\times10^{-4}$ to $1\times10^{-2}$ mole/m$^2$ and preferably from $2\times10^{-4}$ to $2\times10^{-3}$ mole/m$^2$.

In the color diffusion transfer light sensitive component of the present invention, a silver halide emulsion is associated with the dye releasing redox compound.

The silver halide emulsions used in the present invention are hydrophilic colloid dispersions of silver chloride, silver bromide, silver chlorobromide, silver iodobromide, silver chloroiodobromide or a mixture thereof. The halogen component is decided according to the purpose of use and processing conditions of the light sensitive material, but it is particularly preferred to use a silver bromide emulsion and a silver iodobromide or silver chloroiodobromide emulsion (iodide content is 10% by mol or less and chloride content is 30% by mol or less). The silver halide to be used may be any of that having a common particle size and that having a fine particle size, but it is preferred to use those having an average particle size in the range of from about 0.1 micron to about 2 microns. It is sometime preferable for the photosensitive material to have a uniform particle size according to the purpose of use. The crystal form of the particles used may be of any cubic form, octahedral form, and mixed crystal form. These silver halide emulsions can be produced by known conventional processes as described, for example, in *Chemie Photographique,* written by P. Glafkides (2nd Edition, 1957, Paul Montel, Paris), Chapters 18 to 23. It is preferred that the silver halide emulsions used in the present invention are chemically sensitized such as with natural sensitizers contained in gelatin, sulfur sensitizers, such as sodium thiosulfate or N,N,N'-triethylthiourea, gold sensitizers, such as thiocyanate complexes or thiosulfate complexes of monovalent gold or reducing sensitizers, such as stannous chloride or hexamethylenetetramine. In the present invention, it is also possible to use emulsions wherein latent images are easily formed on the surface of particles. Furthermore, it is possible to use not only inner latent image type emulsions as described in U.S. Pat. Nos. 2,592,550 and 3,206,313, but also direct reversal emulsions using desensitizing dyes and solarization type emulsions.

As the above-described solarization type emulsions, emulsions described in The *Theory of the Photographic Process,* edited by Mees (1942, MacMillan Co., New York), pages 261 to 297 are useful. Processes for preparing them have been described, for example, in British Pat. Nos. 443,245 and 462,730 and U.S. Pat. Nos. 2,005,837, 2,541,472, 3,367,778, 3,501,305, 3,501,306 and 3,501,307.

The inner latent image type silver halide emulsions advantageously used in the present invention are those which have sensitivity specks in the inner part of silver halide emulsion particle, by which latent images are selectively formed in the inner part of the particles when exposed to light, while the degree of latent image formation on the surface of the particles is small. Such inner latent image type silver halide emulsions are characterized by that the silver content of images obtained by developing using a surface developing solution (corresponding to surface latent images) according to the process described in *The Theory of Photographic Process* (4th Edition, 1977, edited by T. H. James), pages 171 to 176, after exposed to light is evidently lower than the silver content of images obtained by developing with using an internal developing solution (corresponding to the whole latent images).

Inner latent image type silver halide emulsions can be produced by various processes. Examples thereof include: Burton emulsions having a high iodide content produced by an ammonia process (*Photographic Emulsions,* written by E. J. Wall, pages 35 and 36, and 52 and 53, American Photographic Publishing Co., (1929) and U.S. Pat. Nos. 2,497,875 and 2,563,785); primitive emulsions containing large particles having a low iodine content produced by an ammonia process (German Patent Application (OLS) No. 2,728,108); emulsions which are produced by rapidly reducing the ammonia concentration of a solution of silver halide-ammonia complex salt to precipitate silver halide particles (U.S. Pat. No. 3,511,662); conversion emulsions produced by a catastrophic precipitation process which comprises preparing previously particles of silver salt having high solubility such as silver chloride and converting said silver salt into silver salt having low solubility such as silver bromide or iodide (U.S. Pat. No. 2,592,250); core-shell emulsions produced by a process which comprises mixing a core emulsion of chemically sensitized large particles with an emulsion of fine particles and ripening the mixture to cover the core particles with a shell of silver halide (U.S. Pat. No. 3,206,313 and British Pat. No. 1,011,062); core-shell emulsions produced by a process which comprises covering core particles with a shell of silver halide by adding a solution of soluble silver salt and a solution of soluble halide at the same time to a chemically sensitized monodispersion core emulsion so as to keep the silver ion concentration at a fixed value (British Pat. No. 1,027,146 and U.S. Pat. No. 3,761,276); regional halogen emulsions in which emulsified particles have a laminar construction composed of 2 or more layers and the halogen composition of the first phase is different from that of the second phase (U.S. Pat. No. 3,935,014); and emulsions produced by forming silver halide particles in an acid medium containing trivalent metal ions to incorporate a different metal therein (U.S. Pat. No. 3,447,927).

Typical fogging agents for these emulsions include hydrazines described in U.S. Pat. Nos. 2,588,982 and 2,563,785, hydrazides and hydrazones described in U.S. Pat. No. 3,227,552, and quaternary salt compounds described in British Pat. No. 1,283,835, Japanese Patent Publication No. 38164/74 and U.S. Pat. Nos. 3,734,738, 3,719,494 and 3,615,615.

The dye releasing redox compounds of the invention may be used with a DIR reversal emulsion process as described in U.S. Pat. Nos. 3,227,551, 3,227,554 and 3,364,022 or a reversal emulsion process by dissolution physical development as described in British Pat. No. 904,364.

The silver halide emulsions used in the present invention may be stabilized with additives such as 4-hydroxy-6-methyl-1,3,3a,7-tetrazaindene, 5-nitroimidazole, 1-phenyl-5-mercaptotetrazole, 8-chloro mercury quinoline, benzenesulfinic acid, pyrocatechin, 4-methyl-3-sulfoethylthiazolidine-2-thione or 4-phenyl-3-sulfoethylthiazolidine-2-thione. In addition to them, inorganic compounds such as cadmium salts, mercury salts or complex salts of platinum group elements such as chloro complex salts of palladium, etc., are useful for stabilizing the photosensitive materials of the present invention. Further, the silver halide emulsions used may contain sensitizing compounds such as polyethylene oxide compounds.

The silver halide emulsions used in the present invention are capable of having, if necessary, expanded spectral sensitivity caused by spectral sensitizing dyes. Effective spectral sensitizers include cyanines, merocyanines, holopolar cyanines, styryls, hemicyanines, oxonols and hemioxonols, etc.

Concrete examples of the spectral sensitizers have been described in the above-described text of P. Glafkides: Chapers 35 to 41 and in *The Cyanine and Related Compounds,* by F. M. Hamer (Interscience Co.). Particularly, cyanines wherein the nitrogen atom in the basic heterocyclic group is substituted by an aliphatic group (for example, an alkyl group) having a hydroxyl group, a carboxyl group or a sulfo group, for example, those described in U.S. Pat. Nos. 2,503,776, 3,459,553 and 3,177,210, are especially preferred for practicing the present invention.

The light sensitive component in the color diffusion transfer light sensitive materials according to the present invention is applied to flat materials which do not cause remarkable dimensional deformation during the processing, for example, cellulose acetate films, polystyrene films, polyethylene terephthalate films and polycarbonate films conventionally used for photographic light sensitive materials, laminates thereof and thin glass films.

If the adhesion of the photographic emulsion layer to the base is insufficient, a layer which is adhesive to both of them can be provided as a subbing layer. To further improve adhesion, the surface of the bases may be subjected to preliminary treatment such as corona discharging, ultraviolet ray application or flame treatment.

In addition, paper and water impermeable laminated paper produced by coating the surface of paper with a polymer such as polyethylene, can be used.

It is possible to use processes described in Japanese Patent Publication No. 16356/71, British Pat. No. 1,527,120 and U.S. Pat. No. 3,594,164 as processes for composing laminates of the light sensitive materials.

In the light sensitive component capable of applying the present invention, the silver halide emulsions are combined with the dye releasing redox compounds. Combinations of spectral sensitivity of the silver halide emulsions and spectral absorption of dye images are suitably selected according to the desired color reproduction. In order to reproduce natural color by a subtractive process, a light sensitive component comprising at least two combinations of the emulsion having selective spectral sensitivity in a certain wavelength range and the compound which produces a dye image having selective spectral absorption in the same wavelength range as described is used. Particularly, a light sensitive component comprising a combination of a blue-sensitive silver halide emulsion and a yellow dye releasing redox compound, a combination of a green-sensitive emulsion and a magenta dye releasing redox compound and a combination of a red-sensitive emulsion and a cyan dye releasing redox compound is preferably used. These units of the combinations of emulsions and dye releasing redox compounds may be applied laminarly so as to be a face-to-face relation in the light sensitive component or may be applied as a monolayer composed of a mixture of granular units. In a preferred layer construction, a combination unit of a blue-sensitive emulsion, a combination unit of a green-sensitive emulsion and a combination unit of a red-sensitive emulsion are superposed in this order in the exposing side. Particularly, in the case of using a silver iodide containing high speed emulsion, it is preferred to dispose a yellow filter layer between the combination unit of the blue-sensitive emulsion and the combination unit of the green-sensitive emulsion. The yellow filter contains a yellow colloidal silver dispersion, an oil-soluble yellow dye dispersion, acid dye mordanted on basic polymer or basic dye mordanted on acid polymer. When using a combination units of emulsions, it is preferable to separate them from each other with an intermediate layer. The intermediate layer prevents undesirable interaction occurring between combination units having each different spectral sensitivity. The intermediate layer is composed of, for example, hydrophilic polymers such as gelatin, polyacrylamine or a partially hydrolyzed product of polyvinyl acetate, polymers having fine openings formed from a hydrophilic polymer and a latex of a hydrophobic polymer described in U.S. Pat. No. 3,625,685, or polymers the hydrophilic property of which gradually increases by a processing composition, such as calcium alginate, as described in U.S. Pat. No. 3,384,483.

In order to prevent diffusion of an oxidation product of the developing agent into other combination units of the spectral sensitive emulsion, compounds which operate to catch the oxidation product (for example, color mixing preventing agents such as 2,5-di(sec-dodecyl)hydroquinone) may be added to the above-described intermediate layer.

The dye image receiving component should have a mordanting layer composed of, for example, poly-4-vinylpyridine latex (in, e.g., polyvinyl alcohol) as described in U.S. Pat. No. 3,148,061, polyvinylpyrrolidone as described in U.S. Pat. No. 3,003,872 or quaternary ammonium salt containing polymers as described in U.S. Pat. No. 3,239,337. Other effective mordanting agents include basic polymers described in U.S. Pat. Nos. 2,882,156, 3,625,694 and 3,709,690. Mordanting agents described in U.S. Pat. Nos. 2,484,430, 3,271,147, and 3,184,309 can also be effectively used.

The photographic elements of the present invention preferably function to neutralize alkalis carried by the processing composition. The processing composition contains alkalis in order to provide a sufficiently high pH to accelerate the "image forming step" comprising development of the silver halide emulsions and diffusion of the dye releasing redox compounds. The pH is preferably 11 or more. After substantial conclusion of formation of the diffusion transfer images, the pH in the film unit is neutralized to a near neutral value, namely, less than 9 and preferably less than 8. This substantially stops the image forming step, by which the change of image tone by the lapse of time is prevented and discoloration or fading of images and staining of white areas caused by high alkalinity are repressed. For this purpose, it is preferable to provide the film unit with a neutralization layer containing an acidic substance in an amount sufficient to neutralize alkalis in the processing solution to the above described pH. Acid substances having an area concentration equivalent to or higher than that of alkalis in the spread processing solution are useful for this purpose.

Preferred acidic substances include substances containing acid groups (or precursor groups forming acid groups by hydrolysis) having a pKa of 9 or less. More preferred examples include higher aliphatic acids such as oleic acid as described in U.S. Pat. No. 2,983,606, and polymers of acrylic acid, methacrylic acid or maleic acid and partial esters or acid anhydrides thereof described in U.S. Pat. No. 3,362,819. Examples of high molecular weight acid substances include copolymers of a vinyl monomer such as ethylene, vinyl acetate or vinyl methyl ether, etc. and maleic acid anhydride, n-butyl semiesters of them, copolymer of butylacrylate and acrylic acid, and cellulose acetate acid phthalate. The neutralization layer may contain polymers such as cellulose nitrate, polyvinyl acetate and plasticizers described in U.S. Pat. No. 3,557,237 in addition to the above-described acid substances. Further, the neutralization layer may be hardened by crosslinking reactions by means of polyfunctional aziridine compounds and epoxy compounds. The neutralization layer is disposed in the dye image receiving component and/or the light sensitive component. It is particularly advantageous that it be positioned between the base and the image receiving layer in the dye image receiving component. The acid substances can be incorporated in the film unit as microcapsules, as described, for example, in German Patent Application (OLS) No. 2,038,254.

The neutralization layer or acidic substance containing layer in the above-described case is preferably separated from the spread processing solution layer by a neutralization rate controlling layer (timing layer). This neutralization rate controlling layer has a function of retarding neutralization of the processing solution by the neutralization layer to sufficiently advance the desired development and transfer. The neutralization rate controlling layer is composed of polymers, for example, gelatin, polyvinyl alcohol, polyvinyl propyl ether, polyacrylamide, hydroxypropylmethyl cellulose, isopropyl cellulose, polyvinyl semibutyral, partially hydrolyzed polyvinyl acetate or $\beta$-hydroxyethyl methacrylate-ethyl acrylate copolymer as main ingredients. These polymers are preferably hardened by cross-linking reactions with using aldehyde compounds such as formaldehyde or N-methylol compounds. Examples of the neutralization rate controlling layer have been described in U.S. Pat. Nos. 3,455,686, 4,009,030, 3,847,615, 3,783,075, 3,785,815, 4,088,493, 3,362,819, 3,421,893, 3,706,557, and 3,785,815, Japanese Patent Application (OPI) Nos. 2431/72, 14415/72, and Japanese Patent Publication No. 4214/73, German Patent Application (OLS) No. 1,622,936 and *Research Disclosure* 15162 No. 151 (1976). The neutralization rate controlling layer preferably has a thickness of from 2 microns to 20 microns.

The above-described processing composition is preferably used by putting it in a rupturable container as described in U.S. Pat. Nos. 2,543,181, 2,643,886, 2,653,732, 2,723,051, 3,056,491, 3,056,492 and 3,152,515.

If the photographic element of the present invention is a film unit capable of carrying out photographic processing by passing it through a pair of processing members positioned in parallel after imagewise exposure to light, it comprises, for example, the following components:

(1) a base;

(2) a light sensitive component as described above;
(3) a dye image receiving component as described above;
(4) an alkaline processing composition component as described above; and
(5) a developer (in the processing composition component or the light sensitive component).

A very preferred embodiment of a superposed unification type element used in the present invention has been disclosed in British Pat. No. 1,330,524. According to this embodiment, an image receiving layer, a substantially opaque light reflective layer (for example, a TiO layer or a carbon black layer) and one or more of the above-described light sensitive layers (light sensitive component) are applied in sequence to a transparent base. A transparent cover sheet is superposed thereon so as to have a face-to-face relation. A destructible container filled with an alkaline processing composition containing a clouding agent for intercepting light (for example, carbon black) is disposed so as to be adjacent to the top layer (protective layer) of the above-described light sensitive layer and to the transparent cover sheet. This film unit is exposed to light through the transparent cover sheet and the container is then destroyed by pressing members when the film unit is taken from the camera. Accordingly, the processing composition (containing the clouding agent) is spread between the light sensitive layer and the cover sheet. Thus light sensitive layers are intercepted from light in a sandwich form and the development advances in a lighted room.

In film units according to the foregoing embodiments, it is desirable to use the above-described neutralization mechanism. It is particularly preferred to provide the neutralization layer on the cover sheet (if necessary, a timing layer can be provided on the side on which the processing solution is spread).

Other useful unification type laminates capable of using a photographic element of the present invention have been described in U.S. Pat. Nos. 3,415,644, 3,415,645, 3,415,646, 3,647,487, 3,635,707, and 3,993,486.

In another preferred embodiment, an image receiving component having a laminar construction comprising base-neutralization rate controlling layer-mordanting layer is superposed on a component having one or more light sensitive layers on a base (light sensitive component) in a face-to-face relationship. The above described alkaline processing solution is spread between both components for processing. In this embodiment, the image receiving component may be separated after transfer of the dye image. On the other hand, if the base of the image receiving component is transparent, and a reflection layer is provided between the image receiving layer and the light sensitive layer, as described in U.S. Pat. No. 3,415,645, the image can be viewed without separating the image receiving layer.

The present invention will be illustrated in more detail by reference to the following examples.

EXAMPLE 1

The following layers were applied (in the described order) to a transparent polyethylene terephthalate film base to produce a light sensitive material.

(1) An image receiving layer containing 4.0 g/m$^2$ of copoly(styrene-N-vinylbenzyl-N,N,N-trihexyl ammonium chloride) and 4.0 g/m$^2$ of gelatin.

(2) A white reflection layer containing 22 gm of titanium dioxide and 2.2 g/m$^2$ of gelatin.

(3) An opaque layer containing 2.7 g/m$^2$ of carbon black and 2.7 g/m$^2$ of gelatin.

(4) A layer containing 0.50 g/m$^2$ of a cyan dye releasing redox compound represented by the structure

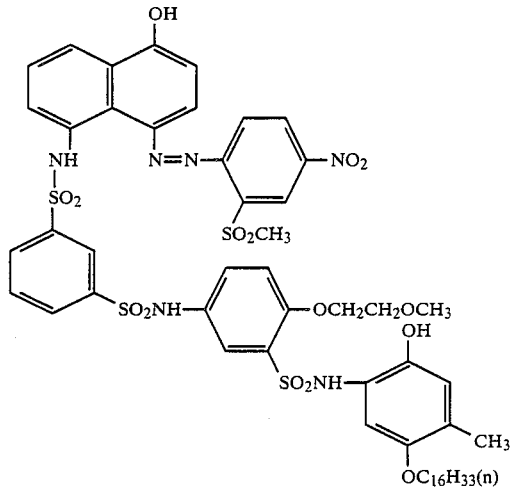

0.50 g/m$^2$ of N,N-diethyllaurylamide and 1.5 g/m$^2$ of gelatin.

(5) A layer containing a red-sensitive inner latent image type emulsion (gelatin 1.1 g/m$^2$, silver 1.4 g/m$^2$), 1-acetyl-2-[4-(2,4-di-pentylphenoxyacetamido)phenyl]-hydrazine (0.015 g/m$^2$) and sodium 2-pentadecyl hydroquinone-5-sulfonate (0.067 g/m$^2$).

(6) A color mixing preventing agent containing layer containing gelatin (1.0 g/m$^2$), 2,5-di-t-pentadecylhydroquinone (1.0 g/m$^2$) and tricresylphosphate (0.5 g/m$^2$).

(7) A layer containing magenta dye releasing redox compound represented by the structure (0.80 g/m$^2$)

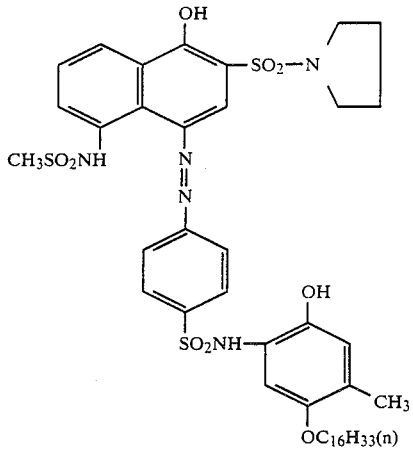

N,N-diethyllaurylamide (0.20 g/m$^2$) and gelatin (1.2 g/m$^2$).

(8) A layer containing a green-sensitive inner latent image type silver bromide emulsion (gelatin 1.1 g/m$^2$, silver 1.4 g/m$^2$), 1-acetyl-2-[4-(2,4-di-t-pentyl-phenoxyacetamido)phenyl]hydrazine (0.015 g/m$^2$) and sodium 2-pentadecylhydroquinone-5-sulfonate (0.067 g/m$^2$).

(9) A color mixing preventing agent containing layer containing gelatin (1.0 g/m$^2$), 2,5-di-t-pentadecylhydroquinone (1.0 g/m$^2$) and tricresylphosphate (0.5 g/m$^2$).

(10) A layer containing a yellow dye releasing redox compound represented by the structure (1.0 g/m$^2$)

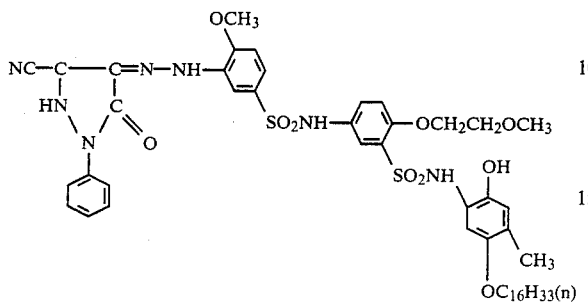

N,N-diethyllaurylamide (0.25 g/m$^2$) and gelatin (1.0 g/m$^2$).

(11) A layer containing a blue-sensitive inner latent image type silver bromide emulsion (gelatin 1.1 g/m$^2$, silver 1.4 g/m$^2$), 1-acetyl-2-[4-(2,4-di-t-pentylphenoxyacetamido)phenyl]hydrazine (0.015 g/m$^2$) and sodium 2-pentadecylhydroquinone-5-sulfonate (0.067 g/m$^2$).

(12) A protective layer containing 1.3 g/m$^2$ of gelatin, 0.9 g/m$^2$ of polyethyl acrylate latex, 0.5 g/m$^2$ of Tinuvin and 0.026 g/m$^2$ of triacryloyl perhydrotriazine as a hardener.

The above-described coated material was imagewise exposed through a continuous wedge using tungsten light of 2854° K. which was converted into light of 4800° K. by means of a Davis Gibson filter (the maximum exposure was 10 C.M.S.). The exposed film was developed with processing solutions having compositions as indicated below.

| Processing Composition A (Control) | |
|---|---|
| Potassium hydroxide | 56 g |
| 4-Hydroxymethyl-4-methyl-1-phenyl-3-pyrazolidinone | 13 g |
| 5-Methylbenzotriazole | 3.5 g |
| 2-Isopropyl-5-methyl hydroquinone | 0.20 g |
| Sodium sulfite | 0.2 g |
| Benzyl alcohol | 1.5 ml |
| Carboxymethyl cellulose | 5.8 g |
| Carbon black | 150 g |

-continued

| Processing Composition A (Control) | |
|---|---|
| Water to make | 1 liter |

Processing composition B to Processing composition J had the same composition as in Processing composition A except that 0.20 g of 2-isopropyl-5-methylhydroquinone was removed and the compound described below was added instead thereof.

To processing composition B, Compound (4) was added, to Processing composition C, Compound (5) was added, to Processing composition D, Compound (12) was added, to Processing composition E, Compound (16) was added, to Processing composition F, Compound (17) was added to Processing composition G, 2,5-dibromohydroquinone was added, to Processing composition H, 2,5-di-t-butylhydroquinone was added, to Processing composition I, 2,5-dimethoxyhydroquinone was added, to Processing composition J, 2-t-butylhydroquinone was added.

A cover sheet was produced by applying the following layer in the described order to a transparent polyethylene terephthalate film base.

(1) A neutralization layer having 7 microns of the thickness containing 17 g/m$^2$ of polyacrylic acid, 0.06 g/m$^2$ of N-hydroxysuccinimidobenzene sulfonate and 0.5 g/m$^2$ of ethylene glycol.

(2) A timing layer obtained by applying cellulose acetate (oxidation value: 54) to make a layer 2 microns.

(3) A timing layer obtained by applying a vinylidene chloride-acrylic acid copolymer latex to make a layer 4 microns thick.

The above-described processing compositions A to J were passed at 25° C. through a pair of rolls placed in parallel, by which they were uniformly spread between the light sensitive component and the cover sheet to create a thickness of 80$\mu$.

After spreading the processing solution, the densities after 24 hours were measured, and the results are shown in the following table.

TABLE 1

| Processing Composition | $D_{max}$ | | | $D_{min}$ | | | $\gamma$ of the Highlight Portion | | | |
|---|---|---|---|---|---|---|---|---|---|---|
| | B | G | R | B | G | R | B | G | R | |
| A | 1.87 | 2.25 | 2.20 | 0.22 | 0.23 | 0.35 | 65.5 | 57.5 | 54.5 | Present Invention |
| B | 1.90 | 2.27 | 2.21 | 0.22 | 0.23 | 0.35 | 64.5 | 55.5 | 53.0 | Present Invention |
| C | 1.91 | 2.27 | 2.24 | 0.22 | 0.23 | 0.35 | 64.5 | 55.0 | 53.0 | Present Invention |
| D | 1.87 | 2.25 | 2.23 | 0.22 | 0.23 | 0.34 | 65.0 | 55.0 | 53.5 | Present Invention |
| E | 1.83 | 2.23 | 2.15 | 0.22 | 0.23 | 0.35 | 67.5 | 56.5 | 54.5 | Present Invention |
| F | 1.88 | 2.20 | 2.10 | 0.23 | 0.23 | 0.35 | 65.5 | 56.0 | 53.0 | Present Invention |
| G | 1.92 | 2.20 | 2.25 | 0.25 | 0.26 | 0.42 | 48.5 | 46.5 | 45.5 | Comparison |
| H | 1.25 | 1.90 | 1.72 | 0.22 | 0.23 | 0.35 | 50.5 | 50.0 | 49.5 | " |
| I | 1.12 | 1.53 | 1.65 | 0.22 | 0.23 | 0.36 | 49.5 | 45.5 | 46.0 | |
| J | 1.89 | 2.32 | 2.30 | 0.23 | 0.24 | 0.37 | 52.5 | 51.0 | 50.0 | " |

The value of $\gamma$ of the highlight portion is shown by the unit mm which is a difference between (1) exposure (represented by logarithm) corresponding to a minimum density (density corresponding to exposure: 1 CMS)+0.1 and (2) exposure (represented by logarithm) corresponding to a minimum density, in the characteristic curve. For instance, 5 mm corresponds to an exposure of logarithm number: 0.1.

As can be understood from the above results, when the compounds according to the present invention were used as in Processing compositions A to F, the gradation of the highlight portion was steep without reducing $D_{max}$ (maximum density) and very preferred gradation can be obtained.

While the invention has been described in detail and with reference to specific embodiments thereof, it will be apparent to one skilled in the art that various changes and modifications can be made therein without departing from the spirit and scope thereof.

What is claimed is:

1. A color diffusion transfer photographic element, comprising: (a) a light sensitive component containing a light sensitive silver halide emulsion layer associated with a dye releasing redox compound; (b) a dye image receiving component; and (c) an alkaline processing composition component, wherein said component (c) contains a diffusible hydroquinone type compound having a gradation controlling effect on the color diffusion transfer element and having a half wave potential of polarography in the range of from −300 mV to −380 mV measured using a saturated calomel electrode as a reference electrode in a buffer solution having a pH of 13.0 at 25° C., wherein the diffusible hydroquinone type compound is represented by the following general formula (I)

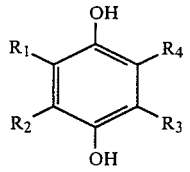

wherein $R_1$, $R_2$, $R_3$ and $R_4$ are independently hydrogen, a halogen atom, a substituted or unsubstituted alkyl group, a substituted or unsubstituted alkoxy group, a substituted or unsubstituted alkylthio group, a substituted or unsubstituted alkenyl group, a cycloalkyl group, a cycloalkoxy group, an aryl group, an acylamino group, a diacylamino group, an acyloxy group, a sulfonamido group, or an alkylamino group, and $R_1$, $R_2$, $R_3$ and $R_4$ combined contain 0 to 12 carbon atoms.

2. A color diffusion transfer photographic element as claimed in claim 1, wherein in the compound represented by general formula (I) two of $R_1$, $R_2$, $R_3$ and $R_4$ each represents hydrogen and the other two of $R_1$, $R_2$, $R_3$ and $R_4$ each represent a substituted or unsubstituted alkenyl group which groups may be the same or different, wherein the total number of carbon atoms included in the groups is 12 or less and wherein said compound is incorporated into the alkaline processing composition.

3. A color diffusion transfer photographic element as claimed in claim 1, wherein the diffusible hydroquinone type compound is represented by the following general formula (I)

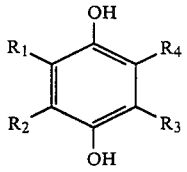

(I)

wherein $R_1$, $R_2$, $R_3$ and $R_4$ are independently hydrogen, a halogen atom, a substituted or unsubstituted alkyl group, a substituted or unsubstituted alkoxy group, a substituted or unsubstituted alkylthio group, a substituted or unsubstituted alkenyl group, a cycloalkyl group, a cycloalkoxy group, an aryl group, an acylamino group, a diacylamino group, an acyloxy group, a sulfonamido group, or an alkylamino group and $R_1$, $R_2$, $R_3$ and $R_4$ combined contain 0 to 12 carbon atoms, with the proviso that when $R_1$ and $R_3$ each are hydrogen and $R^2$ is a substituted or unsubstituted alkyl group having from 1 to 9 carbon atoms, $R_4$ should not be an iso-propyl group.

4. A color diffusion transfer photographic element as claimed in claim 1, wherein an alkyl moiety in the alkyl group, the alkoxy group, the alkylthio group and the alkylamino group represented by $R_1$ to $R_4$ has 1 to 10 carbon atoms.

5. A color diffusion transfer photographic element as claimed in claim 1, wherein an alkenyl group represented by $R_1$ to $R_4$ has 2 to 10 carbon atoms.

6. A color diffusion transfer photographic element as claimed in claim 1, wherein a cycloalkyl moiety in the cycloalkyl group and the cycloalkoxy group represented by $R_1$ to $R_4$ has 5 to 7 carbon atoms.

7. A color diffusion transfer photographic element as claimed in claim 1, wherein an aryl group represented by $R_1$ to $R_4$ is a monocyclic group and has 6 to 10 carbon atoms.

8. A color diffusion transfer photographic element as claimed in claim 1, wherein an acyl moiety in the acylamino group and the acyloxy group represented by $R_1$ to $R_4$ has 2 to 10 carbon atoms.

9. A color diffusion transfer photographic element as claimed in claim 1, wherein the diacylamino group represented by $R_1$ to $R_4$ has 4 to 10 carbon atoms.

10. A color diffusion transfer photographic element as claimed in claim 1, wherein the sulfonamido group represented by $R_1$ to $R_4$ has 1 to 10 carbon atoms.

11. A color diffusion transfer photographic element as claimed in claim 1, wherein a substituent for the substituted alkyl group, the substituted alkoxy group, the substituted alkylthio group and the alkenyl group is selected from the group consisting of a halogen atom, a nitro group, a cyano group, a hydroxy group, a carboxy group, an amino group, a sulfo group, an aryl group or an alkoxy group.

12. A color diffusion transfer photographic element as claimed in claim 1, wherein the diffusible hydroquinone type compound is present in the alkaline processing composition component (c) at a concentration of from 0.01 to 1 g/Kg of the processing composition.

13. A color diffusion transfer photographic element as claimed in claim 1, wherein two of $R_1$, $R_2$, $R_3$ and $R_4$ each represents hydrogen and other two of $R_1$, $R_2$, $R_3$ and $R_4$ each represents a substituted or unsubstituted alkyl group or a substituted or unsubstituted alkenyl group.

14. A color diffusion transfer photographic element as claimed in claim 1, wherein $R_1$, $R_2$ and $R_3$ each represents hydrogen and $R_4$ represents a substituted or unsubstituted alkoxy group.

15. A color diffusion transfer photographic element as claimed in claim 1, wherein the alkaline processing composition has a pH of 11 or more.

16. A color diffusion transfer photographic element as claimed in claim 1, wherein the light sensitive component (a) comprises a combination of a blue-sensitive silver halide emulsion and a yellow dye releasing redox compound, a combination of a green-sensitive silver halide emulsion and a magenta dye releasing redox compound and a combination of a red-sensitive silver halide emulsion and a cyan dye releasing redox compound.

17. A color diffusion transfer photographic element as claimed in claim 1, wherein the dye image receiving component (b) comprises a mordanting layer.

18. A color diffusion transfer photographic element as claimed in claim 17, wherein the dye image receiving component (b) further contains a neutralization layer.

19. A color diffusion transfer photographic element as claimed in claim 18, wherein the dye image receiving component (b) further contains a neutralization rate controlling layer.

20. A color diffusion transfer photographic element as claimed in claim 1, wherein the alkaline processing composition component (c) is present in a rupturable container.

* * * * *